United States Patent [19]

Lubinsky

[11] Patent Number: 4,565,437

[45] Date of Patent: Jan. 21, 1986

[54] HYBRID DEVELOPMENT SYSTEM

[75] Inventor: Anthony R. Lubinsky, Webster, N.Y.

[73] Assignee: Xerox Corporation, Stamford, Conn.

[21] Appl. No.: 549,934

[22] Filed: Nov. 9, 1983

[51] Int. Cl.[4] ..... G03G 15/09

[52] U.S. Cl. ..... 355/3 DD; 118/658

[58] Field of Search ..... 355/3 DD, 3 BE; 118/657, 658; 430/122

[56] References Cited

U.S. PATENT DOCUMENTS

| | | | |
|---|---|---|---|
| 4,294,904 | 10/1981 | Mammino | 430/122 |
| 4,303,331 | 12/1981 | Thompson | 355/3 DD |
| 4,398,496 | 8/1983 | Kopko | 355/3 DD |
| 4,410,260 | 10/1983 | Kuehnle | 355/3 BE |

*Primary Examiner*—R. L. Moses

*Attorney, Agent, or Firm*—H. Fleischer; J. E. Beck; R. Zibelli

[57] ABSTRACT

An apparatus which develops a latent image recorded on a flexble photoconductive member. Developer material comprising conductive carrier granules and magnetic toner particles is transported into contact with the photoconductive member in two development zones. In the first development zone, the flexible photoconductive belt is deflected to wrap about the developer roller. This optimizes development of the solid areas in the latent image. In the second development zone, the developer roller transports the developer material into contact with the latent image. This development zone optimizes development of lines in the latent image with carrier granules adhering to the photoconductive member being removed therefrom.

5 Claims, 3 Drawing Figures

HYBRID DEVELOPMENT SYSTEM

This invention relates generally to an electrophotographic printing machine, and more particularly concerns an apparatus for developing a latent image.

Generally, an electrophotographic printing machine includes a photoconductive member which is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer material into contact therewith. This forms a powder image on the photoconductive member which is subsequently transferred to a copy sheet. Finally, the copy sheet is heated to permanently affix the powder image thereto.

Frequently, the developer material is made from a mixture of carrier granules and toner particles. The toner particles adhere triboelectrically to the carrier granules. This two-component mixture is brought into contact with the latent image. Toner particles are attracted from the carrier granules to the latent image forming a powder image thereof. Most commercial electrophotographic printing machines employ a magnetic brush development system for developing the latent image. The magnetic brush development system may employ one or more developer rollers for transporting the developer material closely adjacent to the photoconductive surface. The developer material may be conductive or insulating. As the toner particles are deposited on the latent image, the brush of developer material accumulates a countercharge which, in turn, collapses the original electrical field responsible for development. In an insulating magnetic brush development system, the speed and number of developer rollers transporting the developer material is typically increased until, by supplying fresh developer material at a sufficiently rapid rate, the field collapse problem is overcome and sufficient solid area development is achieved. In a conductive magnetic brush development system, the brush of developer material has a time constant from electrical charge relaxation which is short compared to the amount of time that the developer material spends in the development zone. Thus, the countercharge is transported away, and the brush of developer material developing the latent image is effectively maintained at the potential of the electrical bias applied to the developer roller. Another approach induces a high mechanical shear between the brush of developing material and the photoconductive surface. This results in agitation of the developer material and physically transports the countercharge away from the latent image. To optimize development, the system should be capable of achieving the benefits of both insulating and conductive developer material. In this way, both solid areas and lines will be optimumly developed in the latent image. Hereinbefore, a two-component development system was utilized wherein magnetic field produced by each magnetic brush developer roller was different. Thus, the first developer roller had a high magnetic field in the development zone in order to develop solid areas efficiently. The second magnetic brush developer roller had a lower magnetic field in the development zone in order to enhance line development. In a system of this type, the lower magnetic field on the last developer roller had the effect of increasing the number of carrier granules adhering to the photoconductive member. This clearly introduces additional contamination problems within the printing machine. Furthermore, the range of developer conductivity for which this type of system was effective was rather small. This reduced the latitude of the developer material.

Various approaches have been devised to improve development. The following disclosures appear to be relevant:

U.S. Pat. No. 3,345,294;
Patentee: Cooper;
Issued: Oct. 3, 1967.
U.S. Pat. No. 3,239,465;
Patentee: Rheinfrank;
Issued: Mar. 8, 1966.
U.S. Pat. No. 4,294,904;
Patentee: Mammino;
Issued: Oct. 13, 1981.
U.S. Pat. No. 4,398,496;
Patentee: Kopko;
Issued: Aug. 16, 1983.

The relevant portions of the foregoing disclosures may be briefly summarized as follows:

Cooper describes a developer powder for reducing the tendency of toner particles to adhere to the background region of a print. The toner particles comprise a polyamide resin mix with a coloring agent and a magnetic substance. The magnetic substance may be present in an amount as small as one percent by weight and preferably about five percent to about 25 percent by weight of the developer powder.

Rheinfrank discloses a toner particle having magnetic particles held in a binder. The magnetic material may be magnetite or hemitite with the binder being an organic resin. The ratio of binder to magnetic particle can vary from 19:1 to 2:3 by weight. For the best results, there should be at least 20% of the magnetic particle but not over 70%.

Mammino teaches a toner particle having a magnetic material present therein which ranges from about 10% to about 80% by weight of the toner material. The preferred amount of magnetic material in the toner particle ranges from about 15% to about 50% by weight. An enhancing additive is present so that the toner particles generate a charge between about 15 microcoulombs and about 30 microcoulombs per gram of toner material.

Kopko discloses a two-roll development system. The first developer roller is spaced from the photoconductive belt and transports developer material into contact therewith in the first development zone. The second developer roller transports developer material into contact with the photoconductive belt in the second development zone. The developer material deflects the photoconductive belt to wrap around the second developer roller.

In accordance, with one aspect of the features of the present invention, there is provided an apparatus for developing a latent image recorded on a flexible member with a developer material comprising at least conductive carrier granules and magnetic toner particles. The apparatus includes first means, positioned closely adjacent to the flexible member defining a first development zone therebetween, for transporting the developer material into contact with the flexible member in the first development zone so as to optimize development of solid areas in the latent image. Second means, spaced from the first transporting means and positioned closely adjacent to the flexible member defining a second development zone therebetween, transports the developer material into contact with the flexible member in the second development zone to optimize development of lines in the latent image and to remove carrier granules adhering to the flexible member. Means are provided for maintaining the flexible member, in the region of at least the first development zone, at a preselected tension of sufficient magnitude so that the developer material being transported into contact with the flexible member in at least the first development zone deflects the flexible member about the first transporting means to form a wrapped development zone.

Pursuant to another aspect of the present invention, there is provided an electrophotographic printing machine of the type having an electrostatic latent image recorded on a flexible photoconductive member. The printing machine includes first means, positioned closely adjacent to the photoconductive member defining a first development zone therebetween, for transporting a developer material comprising at least conductive carrier granules and magnetic toner particles into contact with the photoconductive member in the first development zone so as to optimize development of solid areas in the latent image. Second means, spaced from the first transporting means and positioned closely adjacent to the photoconductive member defining a second development zone therebetween, transport the developer material into contact with the photoconductive member in the second development zone to optimize development of lines in the latent image and to remove carrier granules adhering to the photoconductive member. Means are provided for maintaining the photoconductive member, in the region of at least the first development zone, at a preselected tension of sufficient magnitude so that the developer material being transported into contact with the photoconductive member in at least the first development zone deflects the photoconductive member about the first transporting means to form a wrapped first development zone.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 1:
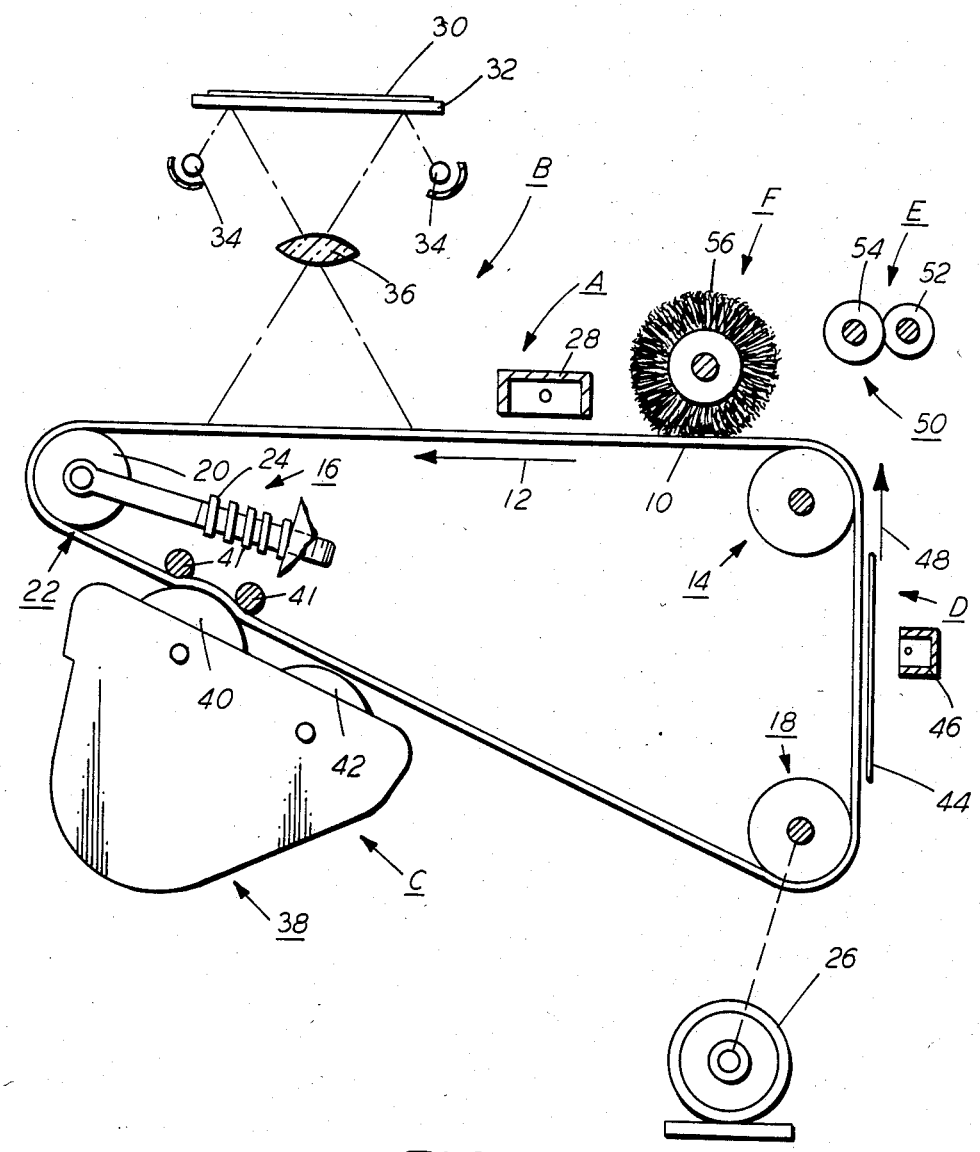
FIG. 1 is a schematic elevational view depicting an electrophotographic printing machine incorporating the features of the present invention therein.

For a general understanding of the illustrative electrophotographic printing machine incorporating the features of the present invention therein, reference is made to the drawings. In the drawings, like reference numerals have been used throughout to designate identical elements. FIG. 1 shematically depicts the various components of an electrophotographic printing machine employing the development system of the present invention therein. Although this development system is particularly well adapted for use in the illustrative electrophotographic printing machine, it will become evident from the following discussion that it is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface deposited on a conductive substrate. By way of example, the photoconductive surface includes a charge generating layer having photoconductive particles randomly dispersed in an electrically insulating organic resin. The conductive substrate comprises a charge transport layer having a transparent, electrically inactive polycarbonate resin with one or more diamines dissolved therein. Belt 10 moves in the direction of arrow 12 to advance success portions of the photoconductive surface sequentially through the various processing stations disposed about the path of movement thereof. The path of movement of belt 10 is defined by stripping roller 14, tensioning system 16, and drive roller 18. As shown in FIG. 1, tensioning system 16 includes a roller 20 over which belt 10 moves. Roller 20 is mounted rotatably in yoke 22. Spring 24, which is initially compressed, resiliently urges yoke 22 in a direction so that roller 20 presses against belt 10. The level of tension is relatively low permitting belt 10 to be easily deflected. The detailed structure of the tensioning system will be described hereinafter with reference to FIG. 2. With continued reference to FIG. 1, drive roller 18 is mounted rotatably and in engagement with belt 10. Motor 26 rotates roller 18 to advance belt 10 in the direction of arrow 12. Roller 18 is coupled to motor 26 by suitable means such as a belt drive. Stripping roller 14 is freely rotatable so as to permit belt 10 to move in the direction of arrow 12 with a minimum of friction.

Initially, a portion of belt 10 passes through charging station A. At charging station A, a corona generating device, indicated generally by the reference numeral 28, charges the photoconductive surface of belt 10 to a relatively high, substantially uniform potential.

Next, the charged portion of the photoconductive surface is advanced through exposure station B. At exposure station B, an original document 30 is positioned facedown upon transparent platen 32. Lamps 34 flash light rays onto original document 30. The light rays reflected from original document 30 are transmitted through lens 36 forming a light image thereof. Lens 36 focuses the light image onto the charged portion of the photoconductive surface to selectively dissipate the charge thereon. This records an electrostatic latent image on the photoconductive surface which corresponds to the informational areas contained within original document 30. One skilled in the art will appreciate that a modulated beam of energy, e.g. a laser beam, may be employed to irradiate selected portions of the charged photoconductive surface to record the electrostatic latent image thereon. The beam of energy is modulated by electronic signals corresponding to information desired to be reproduced. Systems of this type may be employed in association with computer systems to print the desired information therefrom. After the electrostatic latent image is recorded on the photoconductive surface, belt 10 advances the electrostatic latent image to development station C.

At development station C, a magnetic brush development system, indicated generally by the reference numeral 38, advances the developer material into contact with the electrostatic latent image. Preferably, magnetic brush development system 38 includes a developer roller 40 which transports a brush of developer material comprising conductive carrier granules and magnetic toner particles into contact with belt 10. As shown in FIG. 1, developer roller 40 is positioned such that the brush of developer material deflects belt 10 between idler rollers 41 to define a wrapped development zone. The electrostatic latent image attracts the toner particles from the carrier granules forming a toner powder image on the photoconductive surface of belt 10. In this way, the solid areas within the latent image are optimumly developed. Developer roller 42 is spaced from developer roller 40 and, in turn, from belt 10. Developer roller 42 transports the developer material into contact with the latent image to optimumly develop the lines therein, as well as scavenging or removing residual carrier granules adhering to belt 10. The detailed structure of magnetic brush development system 38 will be described hereinafter with reference to FIG. 3.

After development, belt 10 advances the toner powder image to transfer station D. At transfer station D, a sheet of support material 44 is moved into contact with the toner powder image. Sheet 44 is advanced to transfer station D by a sheet feeding apparatus (not shown). Preferably, the sheet feeding apparatus includes a feed roll contacting the uppermost sheet of a stack of sheets. The feed roll rotates so as to advance the uppermost sheet from the stack into a chute. The chute directs the advancing sheet of support material into contact with the photoconductive surface of belt 10 in a timed sequence so that the toner powder image developed thereon contacts the advancing sheet of support material at transfer station D.

Transfer station D includes a corona generating device 46 which sprays ions onto the backside of sheet 44. This attracts the toner powder image from the photoconductive surface to sheet 44. After transfer, sheet 44 moves in the direction of arrow 48 onto a conveyor (not shown) which advances sheet 44 to fusing station E.

Fusing station E includes a fuser assembly, indicated generally by the reference numeral 50, which permanently affixes the toner powder image to sheet 44. Preferably, fuser assembly 50 includes a back-up roll 52 and a heated fuser roll 54. Sheet 44 passes beneath fuser roller 54 and back-up roller 52 with the toner powder image contacting fuser roller 54. In this manner, the toner powder image is permanently affixed to sheet 44. After fusing, a chute guides the advancing sheet to a catch tray for subsequent removal from the printing machine by the operator.

Invariably, after the sheet of support material is separated from the photoconductive surface of belt 10, some residual particles remain adhering thereto. These residual particles are removed from the photoconductive surface at cleaning station F. Cleaning station F includes a rotatably mounted fibrous brush 56 in contact with the photoconductive surface. The particles are cleaned from the photoconductive surface by the rotation of brush 56. Subsequent to cleaning, a discharge lamp (not shown) floods photoconductive surface 12 with light ot dissipate any residual electrostatic charge remaining thereon prior to the charging thereof for the next successive imaging cycle.

It is believed that the foregoing description is sufficient for purposes of the present application to illustrate the general operation of an illustrative electrophotographic printing machine incorporating the features of the present invention therein.

Figure 2:
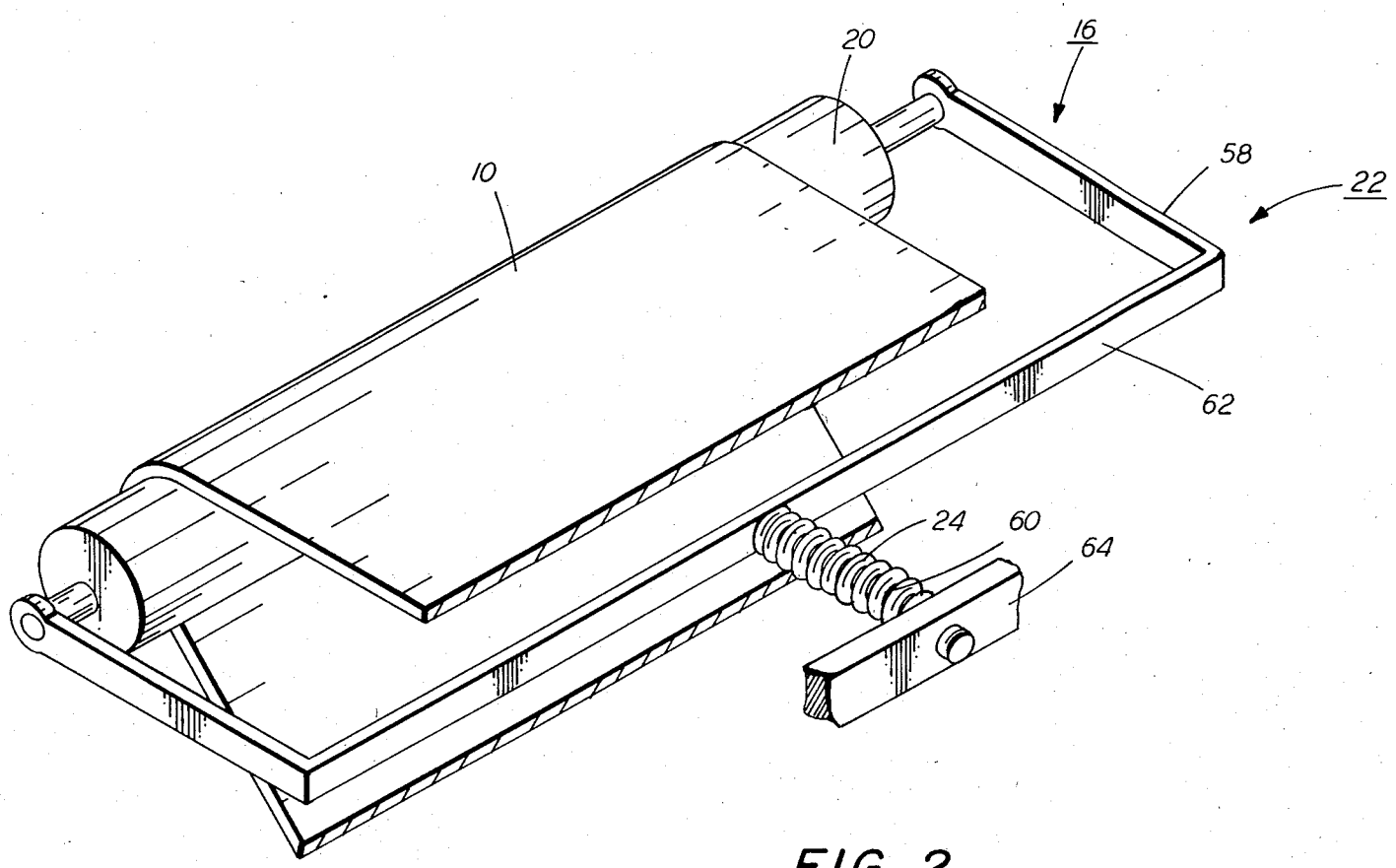
FIG. 2 is a fragmentary, perspective view showing the belt tensioning arrangement for the FIG. 1 printing machine.

Referring now to the specific subject matter of the present invention, FIG. 2 depicts tensioning system 16 in greater detail. As shown thereat, tensioning system 16 includes roller 20 having belt 10 passing thereover. Roller 20 is mounted in suitable bearings in a yoke, indicated generally by the reference numeral 22. Preferably, yoke 22 includes a U-shaped member 58 supporting roller 20 and a rod 60 secured to the midpoint of cross member 62 of U-shaped member 58. A coil spring 24 is wrapped around rod 60. Rod 60 is mounted slidably in the printing machine frame 64. Coil spring 24 is compressed between cross member 62 and frame 64. Compressed spring 24 resiliently urges yoke 22 and, in turn, roller 20 against belt 10. Spring 24 is designed to have the appropriate spring constant so that when placed under the desired compression, belt 10 is tensioned to about 0.1 killograms per linear centimeter. Belt 10 is maintained under a sufficiently low tension to enable the developer material on developer roller 40 to deflect belt 10 about developer roller 40 through an arc of about 12° defining a wrapped development zone.

Figure 3:
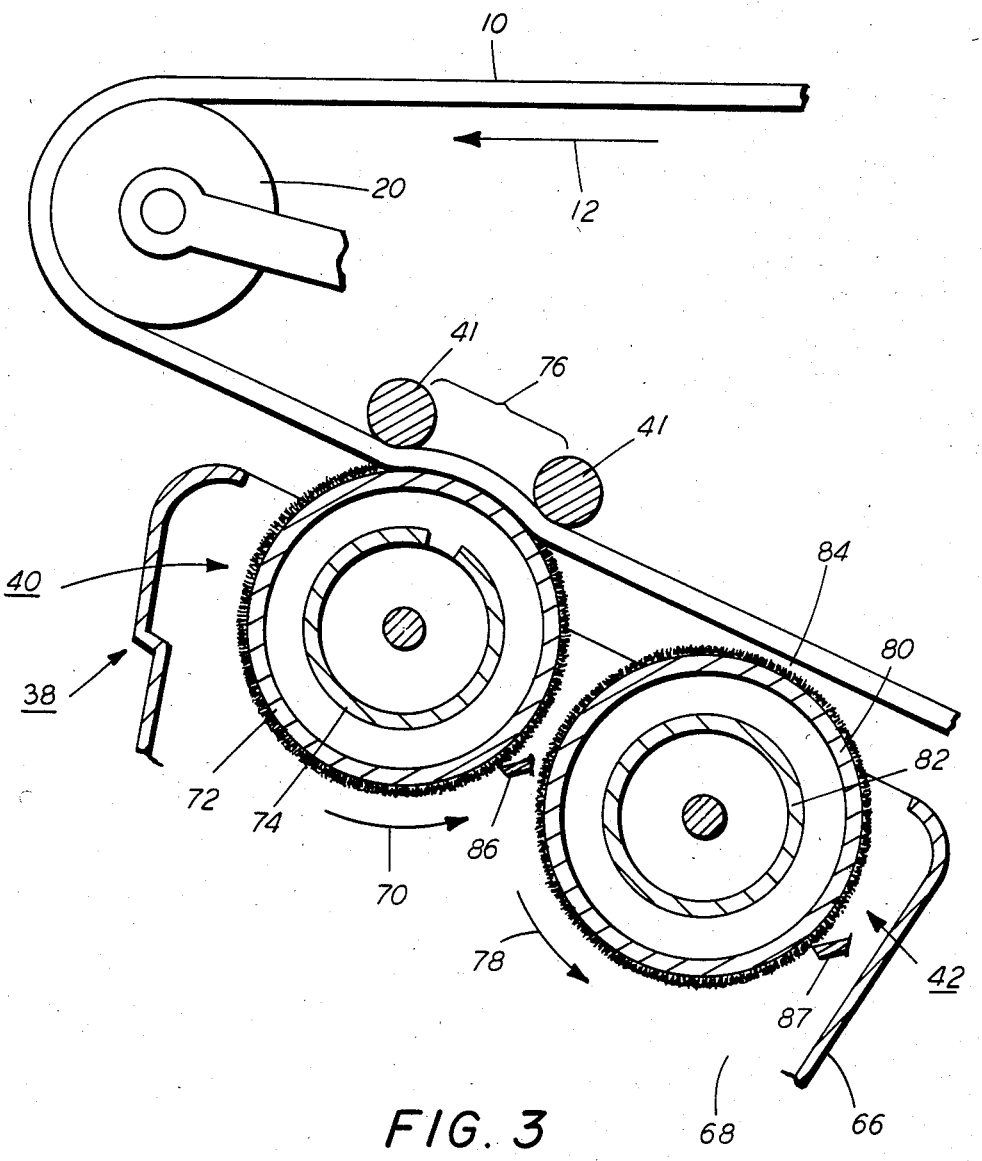
FIG. 3 is an elevational view illustrating the development system used in the FIG. 1 printing machine.

Turning now to FIG. 3, the detailed structure of development system 38 will be described. Development system 38 includes a housing 66 defining a chamber 68 for storing a supply of developer material therein. Augers mix the developer material in the chamber of housing 66 and advance developer material to developer rollers 40 and 42. Developer roller 40 advances the developer material in the direction of arrow 70. Preferably, developer roller 40 includes a non-magnetic tubular member 72, made from aluminum, having the exterior circumferential surface thereof roughened. Elongated magnetic 74 is positioned concentrically within tubular member 72 and mounted on a shaft. Preferably, magnet 74 is mounted stationarily and extends about 300° to maintain a low magnetic field in development zone 76. With the velocity of belt 10 being about 8 ips, the tangential velocity of tubular member 72 is about 22 inches per second. The magnetic field in development zone 76 is low, i.e. less than 100 gauss, to allow the developer material to agitate in development zone 76 optimizing development of solid areas and the electrostatic latent image. The compressed pile height of the developer material on to tubular member 72 is preferably about 0.045 inches. Belt 10 is deflected about tubular member 72 between idler rollers 41 through an arc of about 12°. Preferably, tubular member 72 of developer roller 40 is electrically biased by voltage source (not shown) to a suitable polarity and magnitude. The voltage level is intermediate that of the background voltage level and the image voltage level recorded on the photoconductive surface of belt 10. By way of example, the voltage source electrically biases tubular member 72 to a voltage ranging from about 50 volts to about 350 volts.

Developer roller 42 advances the developer material in the direction of arrow 78 into contact with the electrostatic latent image recorded on the photoconductive surface of belt 10. Developer rollers 40 and 42, as shown in FIG. 3, advance the developer material in a direction opposed to the direction of movement of belt 10. However, one skilled in the art will appreciate that this is not a necessary limitation and that the developer rollers may rotate in opposite directions with respect to one another, or the developer rollers may both rotate in the same direction such that the tangential velocity thereof, in the development zone, is in the same direction or in the opposite direction as that of belt 10. Developer roller 42 includes a non-magnetic tubular member 80 having the exterior circumferential surface thereof roughened. Elongated magnet 82 is positioned concentrically within tubular member 80 and mounted on a shaft. Magnet 82 is mounted stationarily within tubular member 80. Tubular member 80 is mounted on the same shaft as magnet 82 and journaled for rotation thereabout. The closest spacing between tubular member 80 and belt 10, in development zone 84 is about 0.150 inches. Magnet 82 generates a high magnetic field in development zone 84, preferably greater than 300 gauss. The use of a rather high magnetic field in development zone 84 facilitates removal of carrier granules from the photoconductive surface of belt 10. In this way, developer roller 40 develops line in the electrostatic latent image and scavenges or removes residual carrier granules adhering to belt 10. Tubular member 80 rotates at a tangential velocity of about 16 inches per second. The compressed pile height of the developer material adhering to tubular member 80 is about 0.065 inches.

A voltage source is provided for electrically biasing tubular member 80 to a suitable polarity and magnitude. The voltage level is intermediate that of the background voltage level and the image voltage level recorded on the photoconductive surface of belt 10. By way of example, the voltage source electrically biases tubular member 80 to a voltage ranging from about 50 volts to about 350 volts. As shown in FIG. 3, the height of the developer material on rollers 40 and 42 is regulated by trim bars 86 and 87, respectively.

The developer material stored in chamber 68 of housing 66 comprises magnetic toner particles and conductive carrier granules. The toner particles are made from a fusable resin having a magnetic material, such as magnetite dispersed therein. The magnetic portion of the toner particles comprises preferably about 20% to 40% of the weight of the toner particles with the resin or plastic material comprising about 60 to 80% of the toner particles by weight. Small toner particles are utilized. By way of example, the diameter of the toner particles ranges from about 9 to 11 microns. The carrier granules are conductive and have an untoned conductivity equal to or greater than $10^{-9}$ mho.-centimeter$^{-1}$. The carrier granules are magnetic and are preferably made from a ferromagnetic material such as magnetite. By way of example, the carrier granules are about 140 microns in diameter. Toner particles are mixed with the carrier granules such that the toner particle concentration in the developer material ranges from about 2% to about 3%. Preferably, the resultant developer material has a conductivity equal to or less than $10^{-12}$ mho.-centimeters$^{-1}$ in an applied magnetic field strength of approximately 300 gauss.

The development system of the present invention efficiently utilizes two developer rollers. One developer roller optimizes development of solid areas in the electrostatic latent image with the other developer roller optimizing development of low density lines and halftones in the electrostatic latent image. Moreover, the second developer roller scavenges or removes residual carrier beads adhering to the photoconductive belt since a rather high magnetic field is utilized. Hence, the development system of the present invention significantly improves development of a latent image in an electrophotographic printing machine resulting in higher quality copies.

It is, therefore, evident that there has been provided in accordance with the present invention an apparatus for developing an electrostatic latent image that fully satisfies the aims and advantages hereinbefoe set forth. While this invention has been described in conjunction with a preferred embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An electrophotographic printing machine of the type having an electrostatic latent image recorded on a flexible photoconductive member, wherein the improvement includes:

a first tubular member, positioned closely adjacent to the photoconductive member defining a first development zone therebetween, said first tubular member rotating at a first angular velocity for transporting a developer material comprising at least conductive carrier granules and magnetic toner particles into contact with the photoconductive member in the first development zone so as to optimize development of solid areas in the latent image;

a first magnetic member disposed interiorly of and spaced from siad first tubular member to attract the developer material thereto;

a second tubular member, spaced from said first tubular member and positioned closely adjacent to the photoconductive member defining a second development zone therebetween, said second tubular member rotating at a second angular velocity with the first angular velocity being greater than the second angular velocity for transporting the developer material into contact with the photoconductive member in the second development zone to optimize development of lines in the latent image and to remove carrier granules adhering to the photoconductive member;

a second magnetic member disposed interiorly of and spaced from said first tubular member to attract the developer material thereto; and means for maintaining the photoconductive member, in the region of at least the first development zone, at a preselected tension of sufficient magnitude so that the developer material being transported into contact with the photoconductive member in at least the first development zone, deflects the photoconductive member about said first tubular member to form a wrapped first development zone.

2. A printing machine according to claim 1, wherein the photoconductive member is a belt.

3. A printing machine according to claim 2, wherein said first magnetic member produces a magnetic field having a magnitude less than the magnitude of the magnetic field produced by said second magnetic member.

4. A printing machine according to claim 3, wherein the concentration of toner particles in the developer material ranges from about 2% to about 3% by weight thereof.

5. A printing machine according to claim 4, wherein the toner particles have a diameter of about 9 microns.

* * * * *